US008776399B2

(12) United States Patent
Tsai

(10) Patent No.: US 8,776,399 B2
(45) Date of Patent: Jul. 15, 2014

(54) SHOE INSOLE

(75) Inventor: Chen-Yu Tsai, Taipei (TW)

(73) Assignee: Fusco Industrial Corporation, Taipei (TW)

( * ) Notice: Subject to any disclaimer, the term of this patent is extended or adjusted under 35 U.S.C. 154(b) by 389 days.

(21) Appl. No.: 13/357,067

(22) Filed: Jan. 24, 2012

(65) Prior Publication Data

US 2013/0185957 A1 Jul. 25, 2013

(51) Int. Cl.
*A43B 13/38* (2006.01)

(52) U.S. Cl.
USPC ..... 36/44; 36/145; 36/166

(58) Field of Classification Search
USPC ..... 36/43, 44, 145, 166, 173
See application file for complete search history.

(56) References Cited

U.S. PATENT DOCUMENTS 3,233,348 A * 2/1966 Gilkerson ..... 36/44
4,747,410 A * 5/1988 Cohen ..... 36/140
7,140,126 B2 11/2006 Crane et al.
7,958,653 B2 * 6/2011 Howlett et al. ..... 36/44
2001/0000369 A1 * 4/2001 Snyder et al. ..... 36/44
2003/0140523 A1 * 7/2003 Issler ..... 36/37
2004/0025376 A1 * 2/2004 Grisoni et al. ..... 36/44
2008/0072461 A1 * 3/2008 Howlett et al. ..... 36/145
2010/0269371 A1 * 10/2010 Gray ..... 36/43
2013/0025156 A1 * 1/2013 Martinez et al. ..... 36/43
2013/0326906 A1 * 12/2013 Howlett et al. ..... 36/44

* cited by examiner

*Primary Examiner* — Marie Bays
(74) *Attorney, Agent, or Firm* — Wang Law Firm, Inc.; Li K. Wang; Stephen Hsu

(57) ABSTRACT

A shoe insole includes a soft elastomer formed in a shape of an inner bottom surface of a shoe, wherein the soft elastomer includes a front metatarsal section, a mid foot section and a rear heel section, and wherein the rear heel section has a recessed area, and an inner arch concave surface and an outer arch concave surface are respectively defined in two opposite sides of the recessed area; and a hard elastomer combined with the mid foot section and the rear heel section of the soft elastomer, wherein a rear heel section of the hard elastomer has a through-hole, and a portion of material of the soft elastomer is filled in the through-hole, and an inner arch concave surface and an outer arch concave surface are respectively defined in two opposite outer sides of the rear heel section of the hard elastomer.

5 Claims, 6 Drawing Sheets

SHOE INSOLE

BACKGROUND OF THE INVENTION

1. Field of the Invention

The present invention relates to a shoe insole capable of being placed inside a shoe, and more particularly, to an impact absorbing and shock dispersing shoe insole which can meet the requirements of ergonomics and help the wearer to walk at a normal pace.

2. The Prior Arts

During walking, each foot bears the force equivalent to 0.8-1.2 times of the body weight, and the force will directly impact on the foot sole, knee and spine. Thus, a pad is often provided for absorbing the impact. Otherwise, many foot-related problems may occur in a long term period.

A conventional plane leather-made shoe insole only provides cushioning function, which does not provide the shock and impact absorbing function. U.S. Pat. No. 7,140,126 discloses a gel shoe insole capable of being placed inside a shoe for improving the defect of the conventional plane insoles. Such a gel insole takes advantages of elastic property and softness of plastic material (e.g. silicone gel) for absorbing shocks and impacts during walking, so as to get foot protection and comfort. The reason why the gel insoles are so popular is that they can be fabricated thin enough to be placed inside the shoes. For providing comfortable feeling to wear, a fabric capable of absorbing moisture and breathing air is often disposed on the top surface of the gel shoe insole.

However, because the gel shoe insole has a damping effect, the wearer needs to make more strenuous efforts to walk, and thereby he/she easily get muscle fatigue. Moreover, the gel insole is too soft and doesn't provide enough elasticity, and thus the impact resistance is relatively low.

The inner edge of the mid foot section of the foot has a recessed arc-shaped area. When the foot is landed, there is a height difference between the foot arch and the shoe insole. The conventional shoe insole does not provide appropriate structure for supporting the foot arch portion. Thus, the wearer who wears the shoes with the conventional shoe insoles is more likely to feel fatigue during walking.

In addition, the rear heel section of the conventional shoe insole has a flat shape which cannot provide support for the inner and outer arc areas of feet so that the wearer who wears the shoes with the such shoe insoles will feel fatigue during walking.

SUMMARY OF THE INVENTION

An objective of the present invention is to provide a shoe insole that meets the requirements of ergonomics and has good elasticity and impact absorbing capability so that the shoe with the shoe insole of the present invention can be worn comfortable during walking.

Another objective of the present invention is to provide a shoe insole that has an elastic supporting structure to support the foot arch and the heel when the foot is landed, so that foot fatigue can be mitigated.

The shoe insole of the present invention comprises: a soft elastomer which is formed in a shape of an inner bottom surface of a shoe, wherein the soft elastomer comprises a front metatarsal section, a mid foot section and a rear heel section, and wherein the rear heel section has a recessed area, and an inner arch concave surface and an outer arch concave surface are respectively defined in two opposite sides of the recessed area, and wherein the radius of the inner arch concave surface is preferably 7.5 mm to 9 mm, and the radius of the outer arch concave surface is preferably 8.5 mm to 10 mm; and a hard elastomer which is combined with the mid foot section and the rear heel section of the soft elastomer, wherein a rear heel section of the hard elastomer has a through-hole, and a portion of material of the soft elastomer is filled in the through-hole, and an inner arch concave surface and an outer arch concave surface are respectively defined in two opposite outer sides of the rear heel section of the hard elastomer, and wherein the radius of the inner arch concave surface is preferably 13.5 mm to 15.5 mm, and the radius of the outer arch concave surface is preferably 13 mm to 15 mm. The shoe insole of the present invention can be placed inside a shoe, and can meet the requirements of ergonomics so that the wearer wearing the shoe with the shoe insole of the present invention can feel cushioned and comfortable during walking.

The shoe insole of the present invention comprises a soft elastomer and a hard elastomer, wherein the soft elastomer is made of thermoplastic rubber (TPR), thermoplastic elastomer (TPE), thermoplastic polyurethane (TPU), silicone, poron, polyurethane (PU), ethylene-vinyl acetate (EVA), sponge, or rubber, and one of the above materials can be injected and molded into the shape of the inner bottom surface of a shoe, and the soft elastomer comprises a front metatarsal section, a mid foot section and a rear heel section, and wherein the hard elastomer is made of acrylonitrile butadiene styrene (ABS), polypropylene (PP), polyethylene (PE), thermoplastic polyurethane (TPU), or nylon, and one of the above materials can be injection molded to combine with the mid foot section and the rear heel section of the soft elastomer, and wherein a through-hole is defined in the rear heel section of the hard elastomer. Moreover, a portion of the material of the soft elastomer is filled in the through-hole of the hard elastome to provide a buffering effect to the wearer to reduce the impact of foot onto the ground, and the mid foot sections of the soft elastomer and the hard elastomer each has a convex arc surface. Furthermore, an inner arch concave surface and an outer arch concave surface are respectively defined in two opposite sides of the recessed area of a soft elastomer, and an inner arch concave surface and an outer arch concave surface are respectively defined in two opposite outer sides of the rear heel section of the hard elastomer, so that the shoe insole of the present invention can meet the requirements of ergonomics.

The hard elastomer is firstly formed by injection molding, and then the melted TPR, TPE, TPU, silicone, poron, PU, EVA, sponge, or rubber is injection molded and attached to the formed hard elastomer. When the injection formed soft elastomer 1 is at 80 to 230° C., the injection formed soft elastomer is secondary-processed to allow it to be firmly combined with the formed hard elastomer.

Preferably, the top of the recessed area of the soft elastomer has a protruding arc surface.

Preferably, the mid foot section of the soft elastomer combined with the hard elastomer has a convex arc surface.

Preferably, a top layer made of fabric is disposed on the top surface of the soft elastomer.

Preferably, a top layer made of a plastic material with a decorative design is disposed on the top surface of the soft elastomer.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
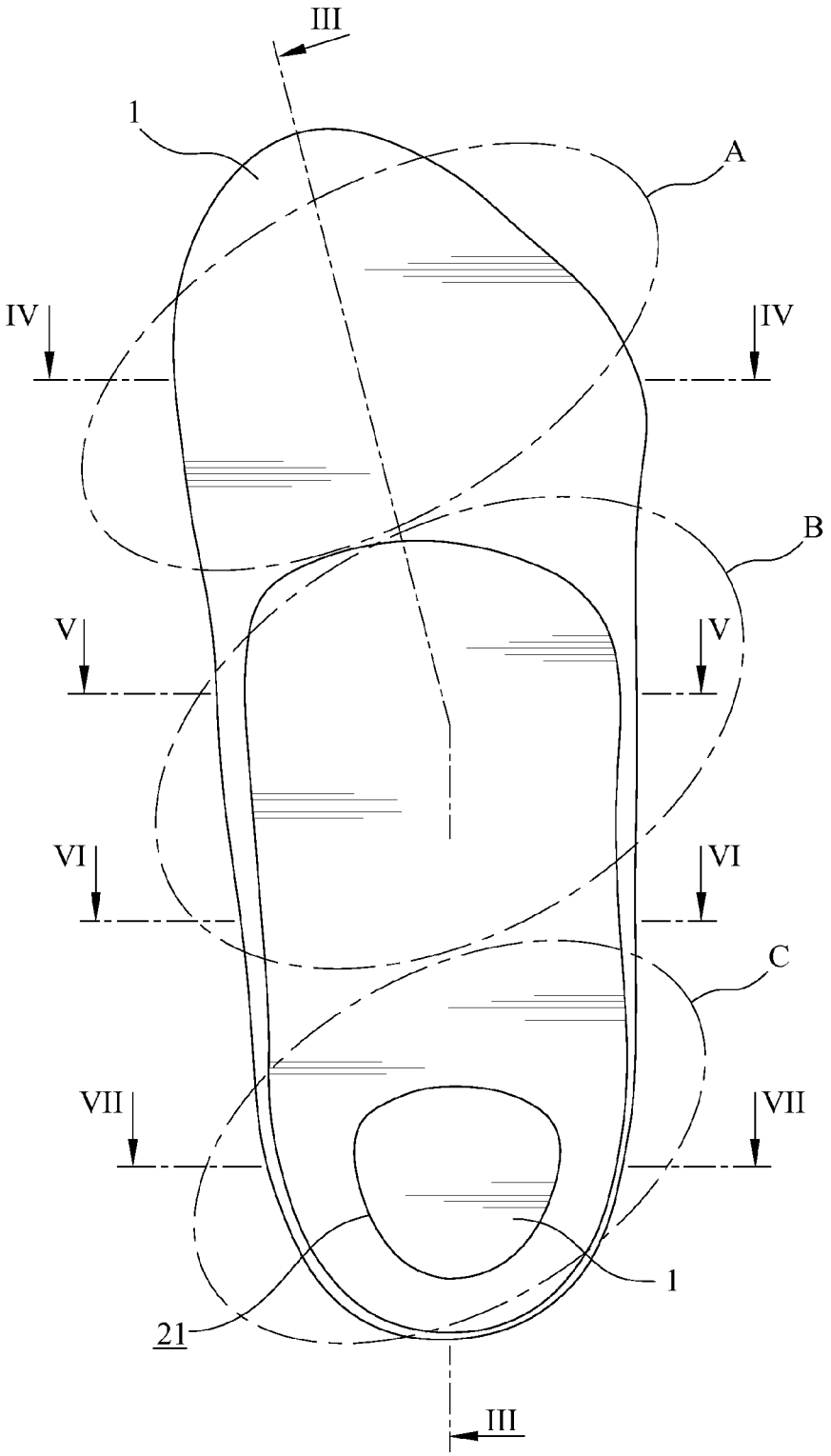
FIG. 1 is a top view showing the structure of the shoe insole according to one embodiment of the present invention.
Figure 2:
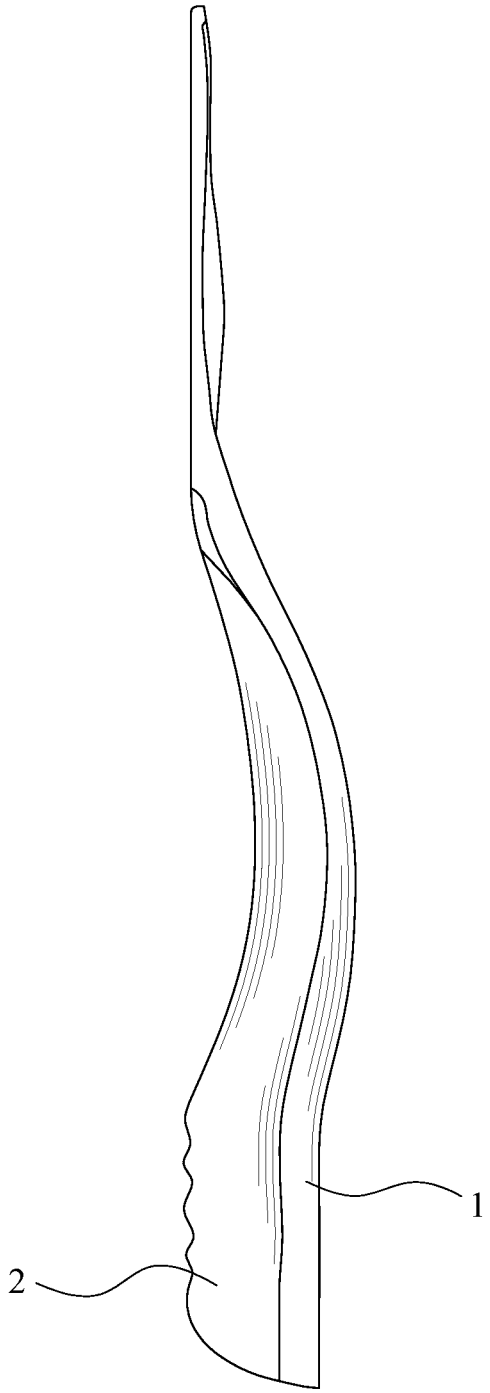
FIG. 2 shows the side view of the shoe insole according to one embodiment of the present invention.
Figure 3:
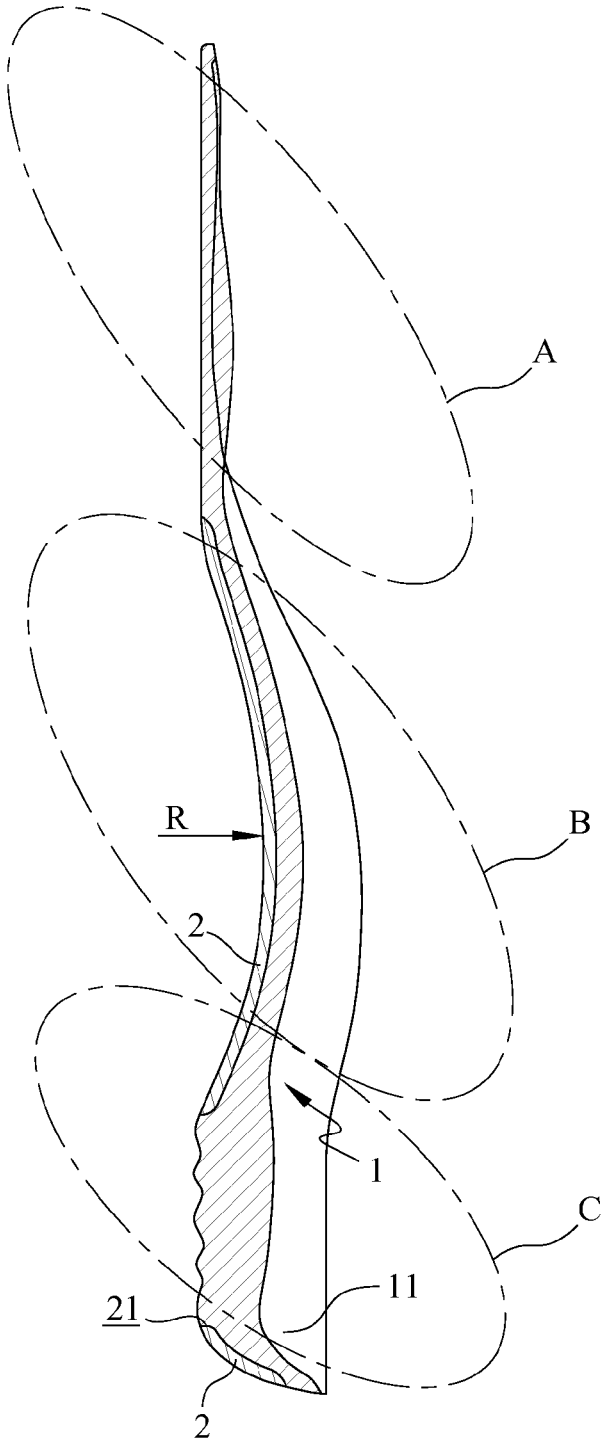
FIG. 3 is a cross sectional view taken along line III-III of FIG. 1.
Figure 4:
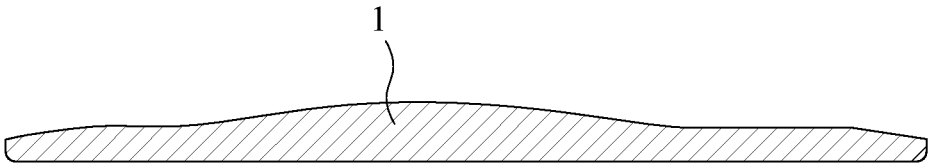
FIG. 4 is a cross sectional view taken along line IV-IV of FIG. 1.
Figure 5:
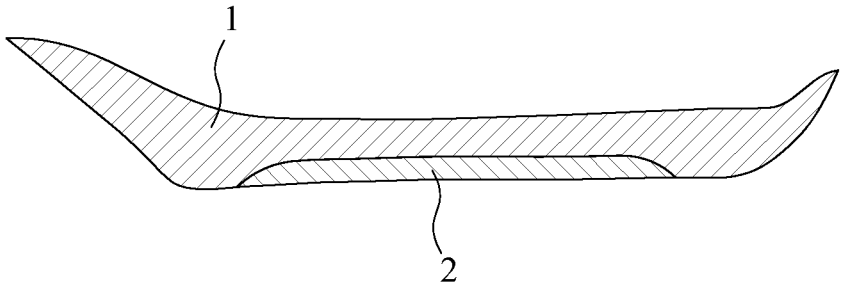
FIG. 5 is a cross sectional view taken along line V-V of FIG. 1.
Figure 6:
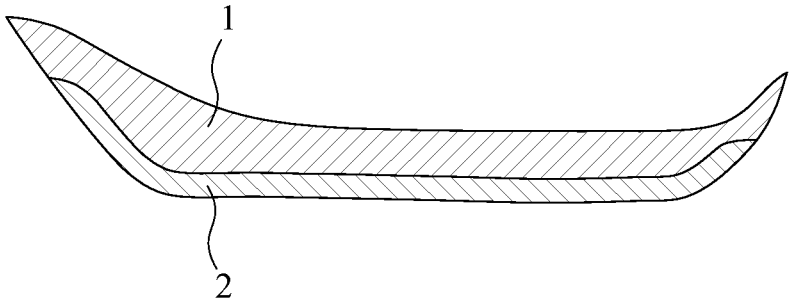
FIG. 6 is a cross sectional view taken along line VI-VI of FIG. 1.

The shoe insoles for a right foot and a left foot are symmetrically designed. Therefore, only the shoe insole for the right foot is taken as an example of the present invention and such a shoe insole can be used for male and female shoes. FIG. 1 is a top view showing the structure of the shoe insole according to one embodiment of the present invention. FIG. 2 shows the side view of the shoe insole, and FIG. 3 is a cross sectional view taken along line III-III of FIG. 1. FIGS. 4 to 7 respectively show the cross sectional view taken along line IV-IV, V-V, VI-VI, and VII-VII of FIG. 1. FIG. 8 shows that a top layer is disposed on the shoe insole of the present invention.

Referring to FIGS. 1 to 3, the shoe insole of the present invention comprises a soft elastomer 1 and a hard elastomer 2, wherein the soft elastomer 1 is made of thermoplastic rubber (TPR), thermoplastic elastomer (TPE), thermoplastic polyurethane (TPU), silicone, poron, polyurethane (PU), ethylene-vinyl acetate (EVA), sponge, or rubber. One of the above materials is injected and molded into the shape of the inner bottom surface of a shoe, and the soft elastomer 1 comprises a front metatarsal section A, a mid foot section B and a rear heel section C. The front metatarsal section A is provided for the forefoot, the mid foot section B is used to be in contact with the mid foot including the foot arch, and the rear heel section C is provided for the foot heel. The peripheral edge of the front metatarsal section A of the soft elastomer 1 is designed according to the contour defined by the toes closed together. The shoe insole is gradually thickened from the rear peripheral edge of the two sides of the front metatarsal section A towards the peripheral edge of the rear heel section C, and therefore the shoe insole is capable of being fitted and fixed in the shoe. When the wearer walks or runs, the foot heel is subject to a larger impact from ground. Therefore, the thickness of the rear heel section C is designed to be thicker than that of the front metatarsal section A. For example, the thickness of the front metatarsal section A is 2 to 3 mm, and the thickness of the rear heel section C is 7 to 8 mm. In consideration of providing comfortable feeling to wear, a top layer 3 is disposed on the top surface of the soft elastomer 1, as shown in FIG. 8. The top layer 3 is, for example, made of a fabric having fluff or a plastic material. Moreover, the top layer 3 can be provided with the decorative designs, patterns, texts or trademarks according to the desired designs.

Figure 7:
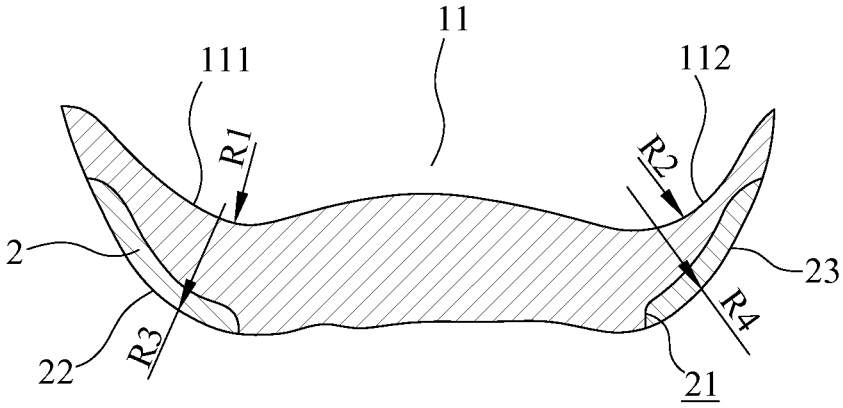
FIG. 7 is a cross sectional view taken along line VII-VII of FIG. 1.
Figure 8:
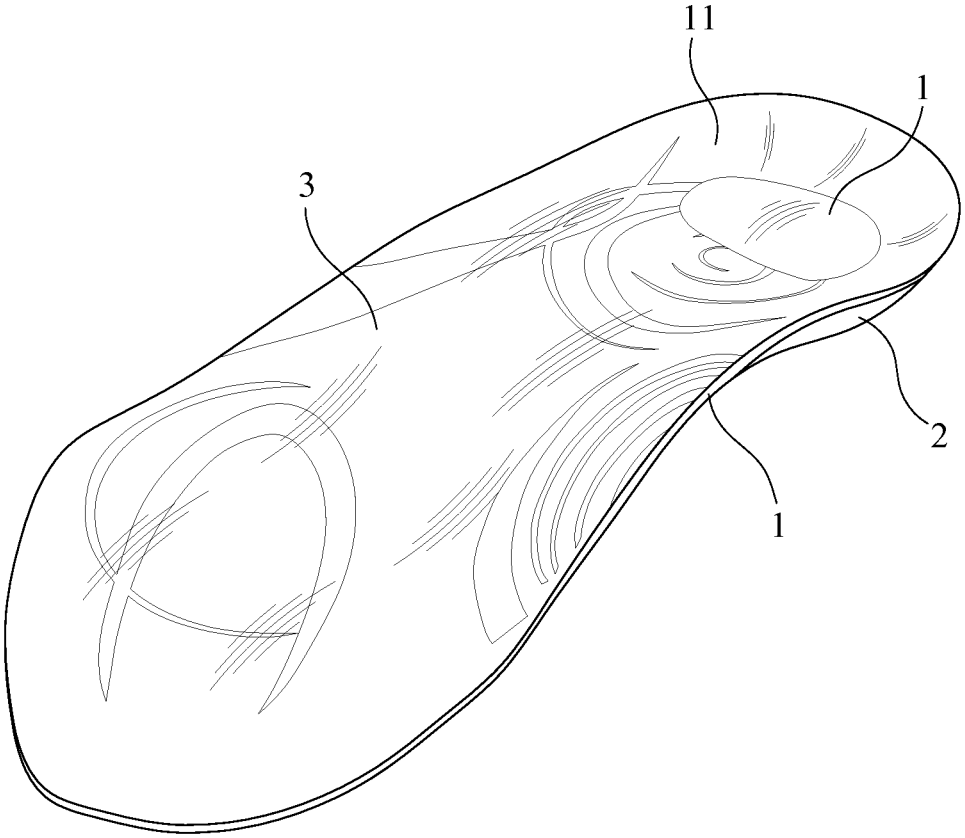
FIG. 8 shows that a top layer is disposed on the shoe insole according to one embodiment of the present invention.

The rear heel section C of the soft elastomer 1 has a recessed area 11 as shown in FIG. 7 so that the wearer's heel can be placed into the recessed area 11. An inner arch concave surface 111 and an outer arch concave surface 112 are respectively defined in two opposite sides of the recessed area 11. The preferable radius R1 of the inner arch concave surface 111 is 7.5 mm to 9 mm, and the preferable radius R2 of the outer arch concave surface 112 is 8.5 mm to 10 mm. The top of the recessed area 11 has a protruding arc surface.

Because the soft elastomer 1 is too soft, a hard elastomer 2 is provided under the soft elastomer 1 in order to enhance the strength and elasticity of the whole shoe insole. According to one embodiment of the present invention, the hard elastomer 2 is made of acrylonitrile butadiene styrene (ABS), polypropylene (PP), polyethylene (PE), thermoplastic polyurethane (TPU), or nylon. One of the above materials is injected and molded into an area which comprises a mid foot section B and a rear heel section C, but not comprises the front metatarsal section A. A through-hole 21 with any shape is defined in the rear heel section C. As shown in FIG. 3, the mid foot section B of the hard elastomer 2 has a convex arc surface which has an arch curvature radius of R. An inner arch concave surface 22 and an outer arch concave surface 23 are respectively defined in two opposite outer sides of the rear heel section C of the hard elastomer 2. The preferable radius R3 of the inner arch concave surface 22 is 13.5 mm to 15.5 mm, and the preferable radius R4 of the outer arch concave surface 23 is 13 mm to 15 mm. The shoe insole having the soft elastomer 1 with the radiuses R1, R2 and the hard elastomer 2 with the radiuses R3, R4 can meet the requirements of ergonomics and provide comfort to the wearer.

The hard elastomer 2 with a desired shape is firstly formed by injection molding, and then the hard elastomer 2 is put into an injection mold used for molding the soft elastomer 1. The melted TPR, TPE, TPU, silicone, poron, PU, EVA, sponge, or rubber is then injected into the injection mold and attached to the hard elastomer 2. Because the soft elastomer 1 and the hard elastomer 2 are made of different materials, they are pseudo-combined with each other. Therefore, the injection formed soft elastomer 1 at 80 to 230° C. is needed to be secondary-processed to allow the soft elastomer 1 to be firmly combined with the hard elastomer 2 so that the soft elastomer 1 combined with the hard elastomer 2 can form the shoe insole after cooling and mold release. A portion of the material of the soft elastomer 1 is filled in the through-hole 21 of the hard elastomer 2. In the secondary processing, an appropriate pressure is applied to the soft elastomer 1 and the hard elastomer 2 so that the soft elastomer 1 can be firmly combined with the hard elastomer 2.

When the shoe insole of the present invention is placed in a shoe for wearing, the foot arch is elastically supported by the convex arc surface of the mid foot section B of the shoe sole, and thereby foot fatigue can be mitigated during walking. In addition, because the periphery of the heel of the wearer is enclosed by the recessed area 11 of the rear heel section C of the shoe sole and the elastic material filled in the through-hole 21 at the rear heel section C, the shoe insole of the present invention meet the requirements of ergonomics and provides a buffering effect to the wearer to reduce the impact of foot onto the ground, so that the wearer will feel comfortable to wear it.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A shoe insole, comprising:

a soft elastomer formed in a shape of an inner bottom surface of a shoe, the soft elastomer comprising a front metatarsal section, a mid foot section and a rear heel section, the rear heel section having a recessed area, an inner arch concave surface and an outer arch concave surface being respectively defined in two opposite sides of the recessed area, a radius of the inner arch concave surface being 7.5 mm to 9 mm, and a radius of the outer arch concave surface being 8.5 mm to 10 mm; and a hard elastomer combined with the mid foot section and the rear heel section of the soft elastomer, a rear heel section of the hard elastomer having a through-hole, a portion of material of the soft elastomer being filled in the through-hole, an inner arch concave surface and an outer arch concave surface being respectively defined in two opposite outer sides of the rear heel section of the hard elastomer, a radius of the inner arch concave surface being 13.5 mm to 15.5 mm, a radius of the outer arch concave surface being 13 mm to 15 mm.

2. The shoe insole according to claim 1, wherein a top of the recessed area of the soft elastomer has a protruding arc surface.

3. The shoe insole according to claim 1, wherein the mid foot section of the soft elastomer combined with the hard elastomer has a convex arc surface.

4. The shoe insole according to claim 1, wherein a top layer is disposed on a top surface of the soft elastomer.

5. The shoe insole according to claim 1, wherein a top layer made of a plastic material with a decorative design is disposed on a top surface of the soft elastomer.

* * * * *